United States Patent [19]

Caduff

[11] Patent Number: 4,890,567

[45] Date of Patent: Jan. 2, 1990

[54] ROBOTIC ULTRASONIC CLEANING AND SPRAYING DEVICE FOR SHIPS' HULLS

[76] Inventor: Edward A. Caduff, 258 West Deer Park Rd., Gaithersburg, Md. 20877

[21] Appl. No.: 127,181

[22] Filed: Dec. 1, 1987

[51] Int. Cl.[4] ..... B63B 59/08

[52] U.S. Cl. ..... 114/222; 118/207; 118/305; 134/1

[58] Field of Search ..... 114/222; 134/1, 184; 118/207, 305; 180/901; 15/1.7, 320

[56] References Cited

U.S. PATENT DOCUMENTS

| | | | |
|---|---|---|---|
| 2,118,276 | 5/1938 | Temple | 118/207 |
| 2,132,661 | 10/1938 | Temple | 114/222 X |
| 3,068,829 | 12/1962 | Nuissl | 114/222 |
| 3,960,229 | 6/1976 | Shio | 180/901 |
| 4,270,484 | 6/1981 | Shimatani et al. | 114/222 |
| 4,444,146 | 4/1984 | Dewitz et al. | 114/222 |

*Primary Examiner*—Sherman D. Basinger
*Attorney, Agent, or Firm*—Wigman & Cohen

[57] ABSTRACT

A robotically operated device uses an ultrasonic transducer for the cleaning of ships' hulls. The device may also be used for spraying paints or other chemicals on the sides of ships' hulls. The device includes a housing having an open face adapted to confront a ship's hull and apparatus disposed in the housing for impinging a flow of fluid through the open face onto the ship's hull. An ultrasonic transducer is disposed in the housing for impinging a flow of ultrasonic energy through the open face onto the ship's hull. Apparatus connected to the outside of the housing retains the housing on the ship's hull and moves the housing on the ship's hull. In an additional embodiment, apparatus for spraying paint or other chemicals on a ship's hull is disposed in the housing.

18 Claims, 4 Drawing Sheets

ROBOTIC ULTRASONIC CLEANING AND SPRAYING DEVICE FOR SHIPS' HULLS

BACKGROUND OF THE INVENTION

The present invention relates to a device for cleaning ship's hulls and more particularly to a robotically operated device using ultrasonic means for the cleaning of ship's hulls.

Fuel savings of several hundred million dollars annually are expected from a pending Navy decision to use anti-fouling hull paints based on toxic tributylin compounds. Several Navy trials have demonstrated that these paints routinely out perform the current military specification paints based on cuprous oxide. Additional savings are expected as a result of less frequent dry-docking and the elimination of underwater hull cleaning. Current hull cleaning methods in just eight (8) Navy ship yards use 45,000 tons of abrasive that would have to be detoxified if used on the organic paint, and 180 million gallons of water that would have to be treated annually.

The organotin/tributylin paints have the capability of keeping the hull of a ship free of calcerous fouling for 5 to 7 years without underwater cleaning. Use of the paints would increase the operational availability of the Navy ships as well as commercial ships. The paints would also improve the operational readiness by maintaining the maximum speed and range of the ships over a much longer period of time due to the absence of calcerous fouling.

Satisfactory methods need to be developed to manage the organic waste during the application of the paint, removal of spent paints in dry-dock prior to repainting, and detoxification of the grit and other wastes generated during the present abrasive blasting method used.

There are presently three existing cleaning methods which are used for cleaning ship's hulls:

1. Chemical paint strippers are currently used to remove small patches on the holes required for non-destructive testing and access cuts. This method is unsuitable for cleaning the entire ship's hull.

2. Abrasive grit blasting is used for cleaning the entire hull, resulting in toxic wastes that could amount to 54,000 tons of grit per year that would have to be detoxified by some method, as well as over 180 million gallons of water that would have to be treated just from 8 Naval ship yards. Solid grit waste disposal methods presently being evaluated to manage organic paint wastes include landfill disposal and incineration.

3. An experimental High Pressure Cavitating Water Jet System (CWJS), using pressures of 10,000 to 15,000 psi in a special nozzle has been developed in a manual prototype. The prototype produced a 500 percent increase in efficiency over the chemical strippers used on the 5 foot by 6 foot hole patches. Attempts are being made by the Navy to scale up and robotize the system for cleaning the entire hull.

A search of the prior art failed to uncover any prior art references which disclose the robotic ultrasonic device for cleaning of ship's hulls of the present invention. One patent was uncovered which discloses an ultrasonic decontamination robot. The patent uncovered during the aforementioned search is as follows:

| U.S. Pat. No. | Inventor | Issue Year |
|---|---|---|
| 4,595,419 | Patenaude | 1986 |

While Patenaude is directed to an ultrasonic decontamination robot, the disclosed device is designed to remove radioactive contamination by ultrasonic induced cavitation in a fluid medium from the internal surface of the inlet and outlet headers, divider plate, tube sheet, and lower portions of tubes of a nuclear power plant steam generator. As such, the device of Patenaude is unsuitable for cleaning ship's hulls.

SUMMARY AND OBJECTS OF THE INVENTION

In view of the foregoing limitations and shortcomings of the prior art devices, as well as other disadvantages not specifically mentioned above, it is a primary object of this invention to provide a means for robotically and ultrasonically removing marine anti-fouling paints containing toxic tributylin compounds and restricting the resulting effluents from contaminating surrounding areas.

More particularly, it is an object of this invention to provide a device for ultrasonically cleaning ship's hulls which can be positioned on a ship's hull in dry-dock and moved across the ship's hull under control from a remote location, in order to clean large areas of the ship's hull.

It is another object of this invention to provide a device for cleaning ship's hulls which uses ultrasonic cavitation to perform the cleaning action.

Yet another object of this invention is to provide a device for spraying paints or other chemicals on a ship's hull, which is positioned on the ship's hull and moved across the surface of the ship's hull from a remote location.

Briefly described, the aforementioned objects are accomplished according to the invention by providing a housing having an open face adapted to confront a ship's hull. Fluid spray heads are disposed in the housing for impinging the flow of fluid through the open face onto the ship's hull. At least one ultrasonic transducer is disposed in the housing and positioned so as to impinge a flow of ultrasonic energy through the open face onto the ship's hull. A gear driven electromagnetic track system is disposed on the outside of the housing for retaining the housing on the ship's hull and moving the housing on the ship's hull from a remote location. In an additional embodiment of the invention, the housing is provided with spray heads to spray paint or other chemicals on the surface of the ship's hull.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
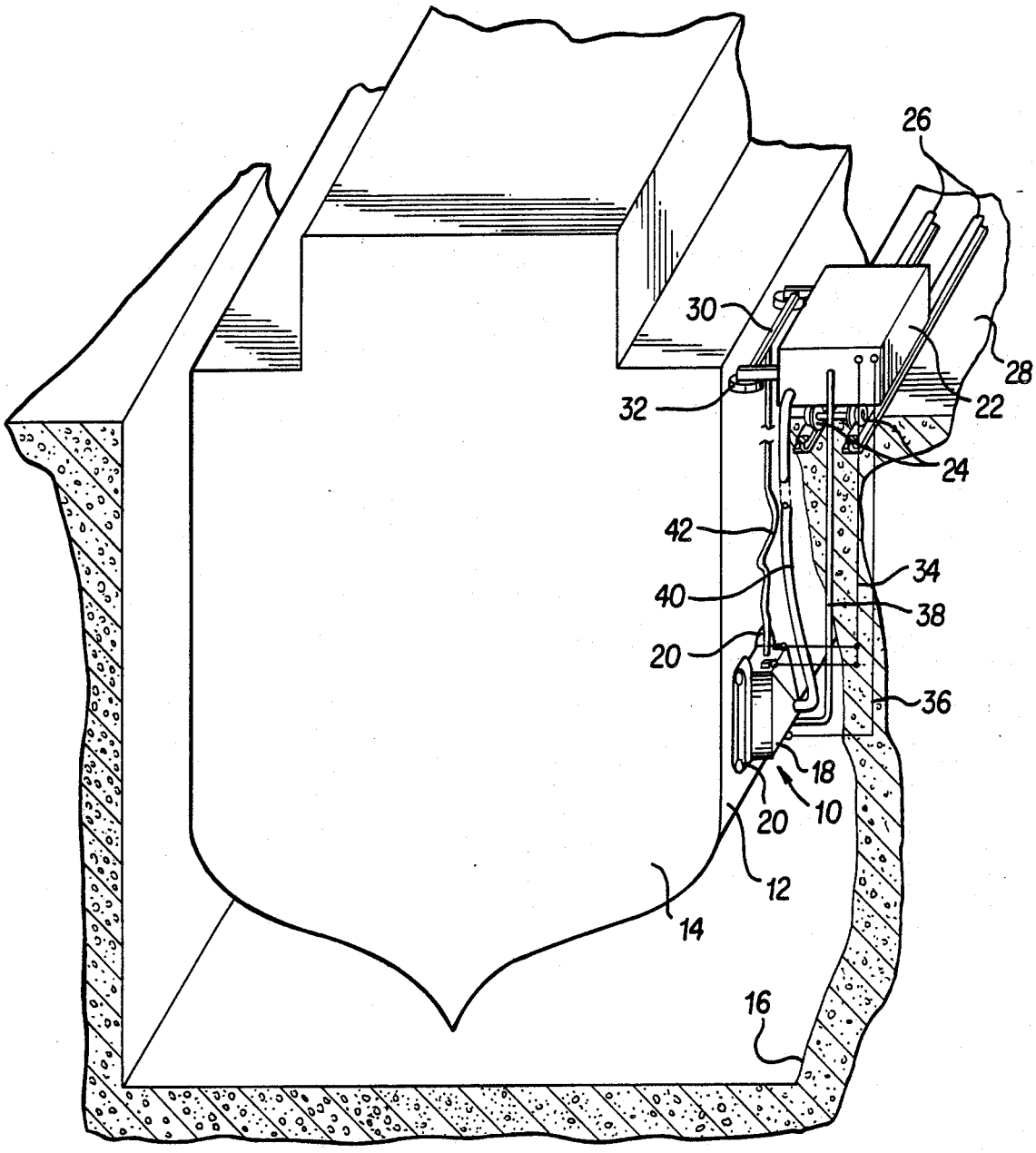
FIG. 1 is a perspective view of the cleaning device in accordance with the invention, in position on the hull of a dry-docked ship.

Referring now in detail to the drawings wherein like parts are designated by like reference numerals throughout, there is illustrated in FIG. 1 a robotic ultrasonic device for cleaning ship's hulls in accordance with the present invention which is designated generally by reference numeral 10.

As illustrated in FIG. 1, cleaning device 10 is illustrated in cleaning position on the hull 12 of a ship 14 which is fitted in a dry-dock 16. Cleaning device 10 comprises a housing 18 containing cleaning apparatus, which will be described in greater detail hereinafter in connection with FIGS. 2, 3, and 4, and electromagnetic tracks 20 for retaining the housing 10 on the ship's hull and moving the housing on the ship's hull, which will be described in greater detail hereinafter in conjunction with FIGS. 2 through 8.

Cleaning device 10 is also provided with a control and power supply car 22 having wheels 24 which ride on tracks 26 fixed to the surface of a platform 28 of dry-dock 16. Located within control and power supply 22 are all controls and power supplies needed to control the operation of cleaning device 10. Control and power supply car 22 is provided with an extension 30 supporting rollers 32 which rest against ship's hull 12. Extension 30 and rollers 32 provide lateral support for car 22 as it rides along tracks 26 during cleaning operations. Power lines 34 are provided between car 22 and cleaning device 10 to supply electrical power to electromagnetic tracks 20 and the drive means for the electromagnetic tracks (described hereinafter). Power line 36 is provided between car 22 and cleaning device 10 to provide electrical power for air motors (described hereinafter) which are contained within housing 18. A fluid supply line 38 and a vacuum exhaust line 40 are provided extending between car 22 and cleaning device 10 which supply and exhaust fluid to and from housing 18, respectively, as will be described in detail hereinafter. A tether 42 is fixed at one end to housing 18 and at the other end to either car 22 or platform 28, to prevent cleaning device 10 from falling to the bottom of dry-dock 16 in the event of an electrical power failure or similar mishap in which electromagnetic tracks 20 are no longer able to retain cleaning device 10 on ship's hull 12.

Figure 3:
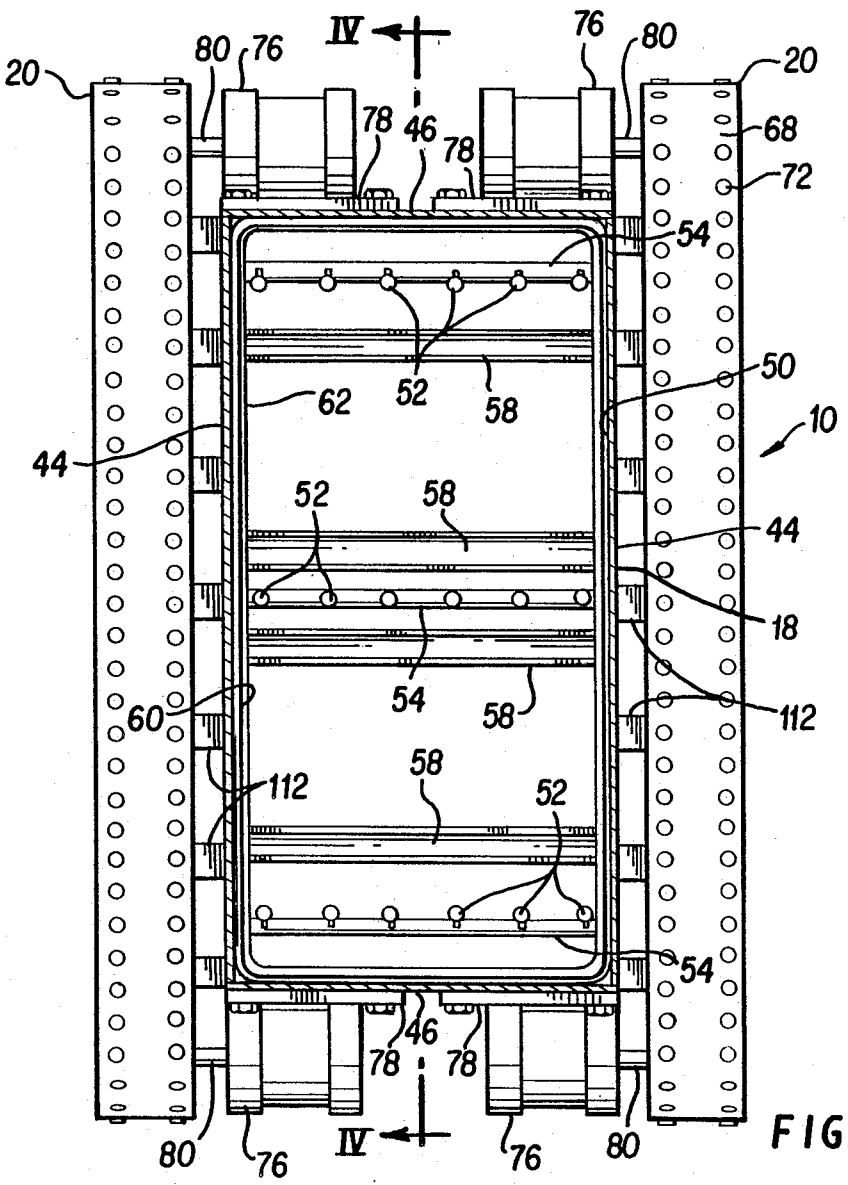
FIG. 3 is a bottom view of the cleaning device in accordance with the present invention, as viewed along line III—III of FIG. 2.
Figure 2:
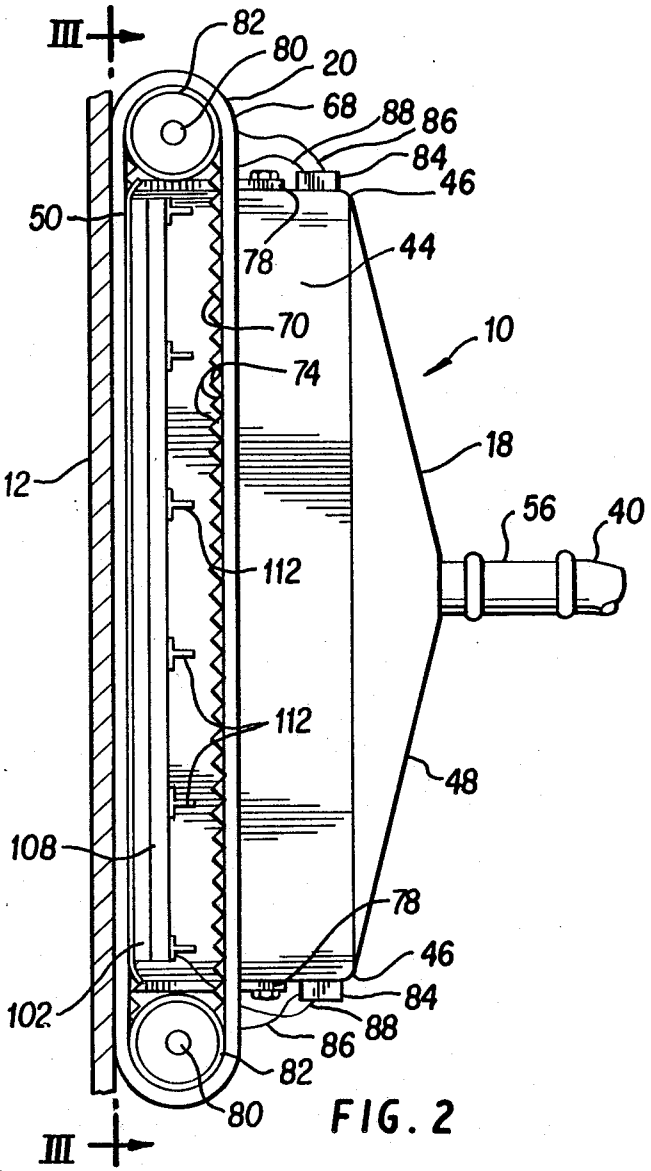
FIG. 2 is a side view of a cleaning device in accordance with the present invention, in position for cleaning on a ship's hull.
Figure 4:
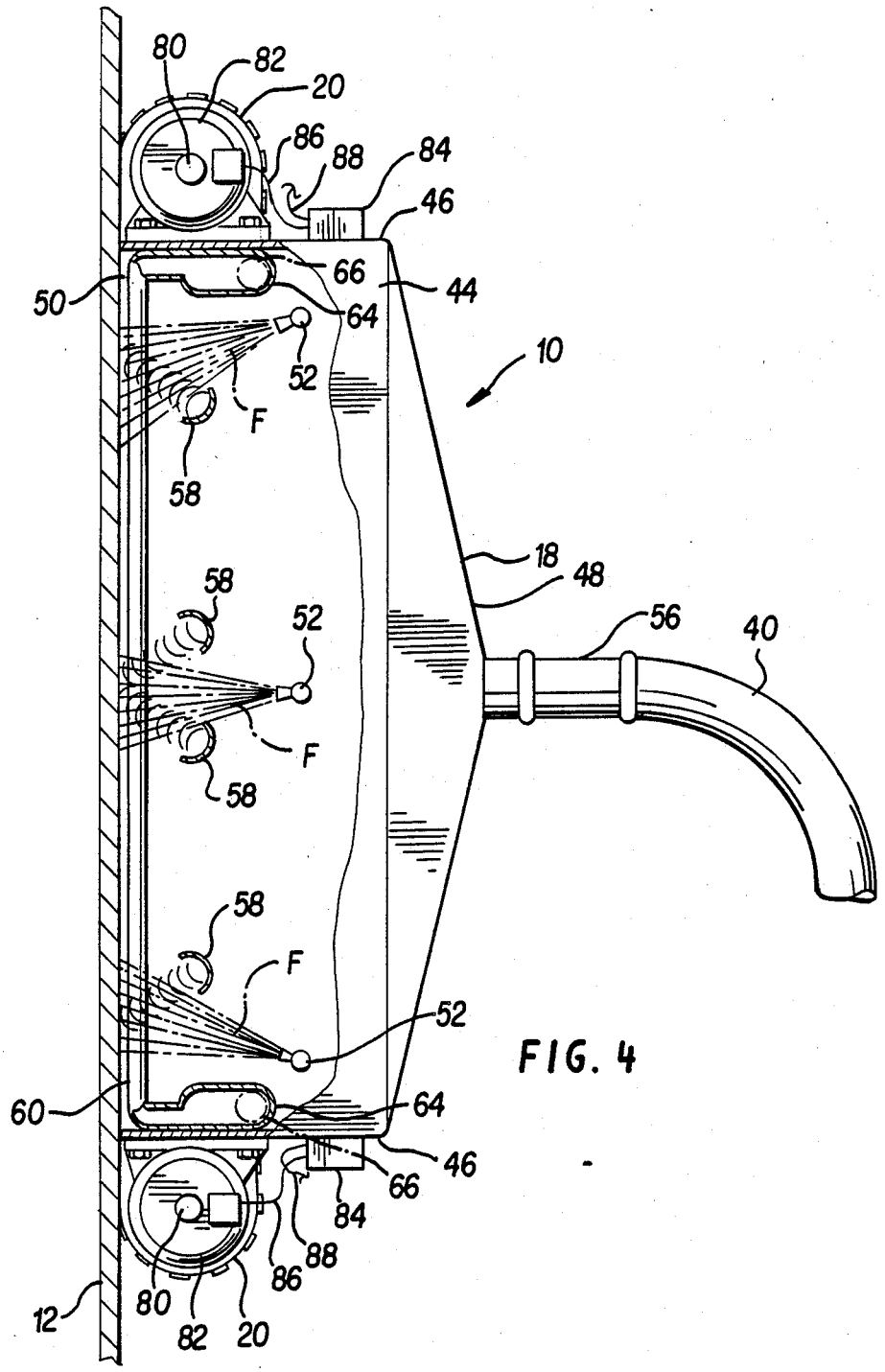
FIG. 4 is a partial cross sectional view of the cleaning device of the present invention, taken along line IV—IV of FIG. 3.
Figures 5, 6, 7, 8:
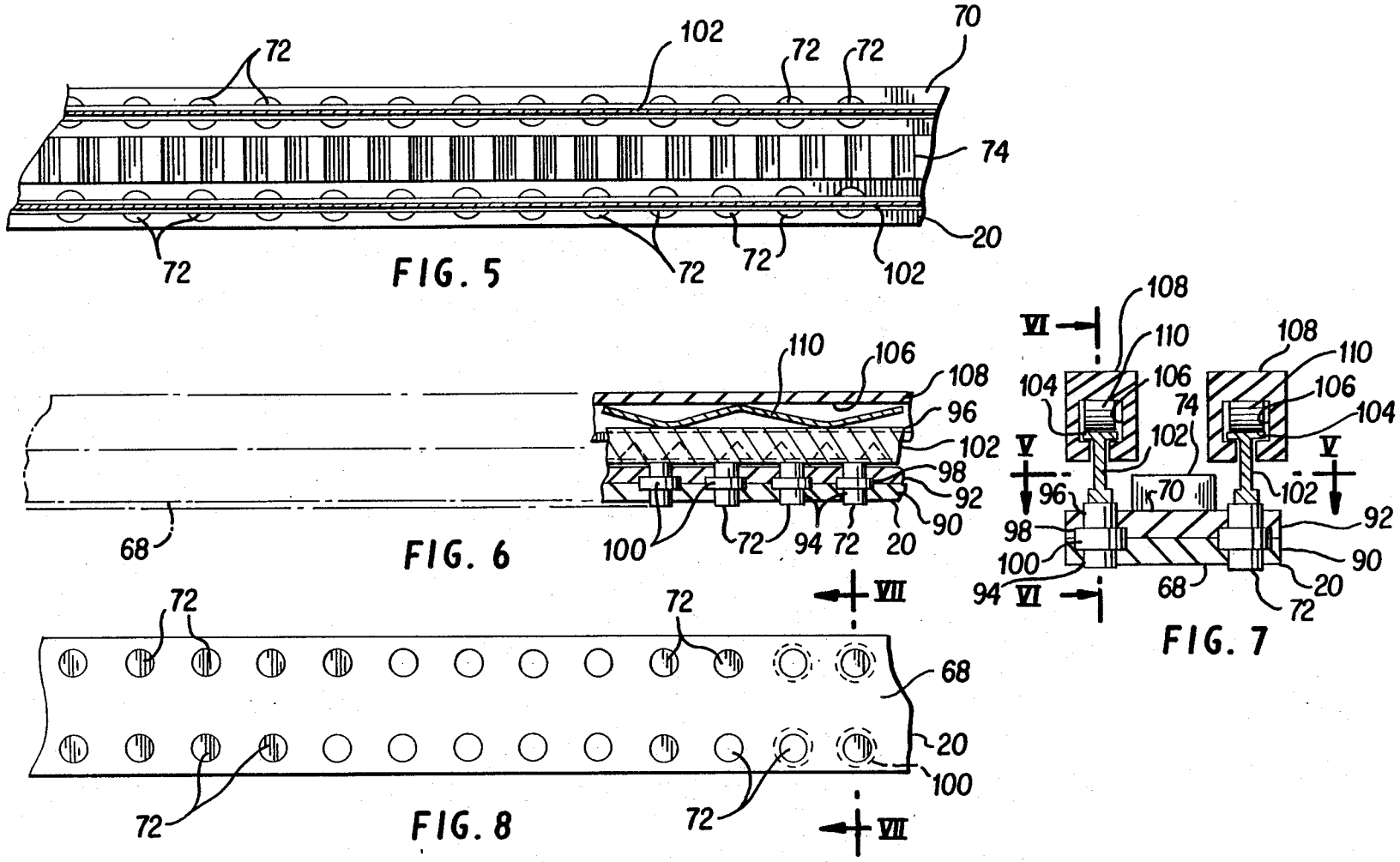
FIG. 5 is a cross sectional view, taken along line V—V of FIG. 7, showing a portion of one of the electromagnetic tracks of the cleaning device of the present invention.
FIG. 6 is a cross sectional view taken along line VI—VI of FIG. 7.
FIG. 7 is a cross sectional view of one of the electromagnetic tracks for retaining the cleaning device of the present invention on a ship's hull and for moving the cleaning device on the ship's hull, together with electrical current contact strips for supplying electrical current to the electromagnetic track and supports for supporting the electrical current contact strips on the cleaning device of the present invention.
FIG. 8 is a bottom view of a portion of one of the electromagnetic tracks of the cleaning device of the present invention.

Referring now to FIGS. 2 through 4, details of the cleaning device 10 of the present invention will now be described. Cleaning device 10 includes a generally rectangularly-shaped housing 18 having two opposed side walls 44, two opposed end walls 46, and a top wall 48. Opposite top wall 48, housing 18 is provided with an open face 50, having a generally rectangular shape, extending between side walls 44 and end walls 46.

Disposed within housing 18 are a plurality of fluid spray heads 52, arranged so as to spray a fluid F through the open face 50 of housing 18 against a ship's hull 12, when the device 10 is in position for cleaning operation, as illustrated particularly in FIG. 4. In the preferred embodiment, as illustrated particularly in FIG. 3, a plurality of fluid spray heads 52 are arranged in each of three rows, which rows lie in a plane which is parallel to the plane of end walls 46. Each of the fluid spray heads 52 in each of the three rows are fed by fluid manifolds 54. In the preferred embodiment, fluid manifolds 54 are fed with fluid through fluid supply line 38 (FIG. 1) which are connected with fluid tanks disposed within control and power supply car 22. It will be appreciated that any number of fluid spray heads 52 may be disposed in any suitable arrangement within housing 18, consistent with the present invention. Furthermore, it will be appreciated that fluid supply tanks, connected with a manifold or manifolds 54, may be disposed inside or connected to the outside of housing 18, consistent with the present invention. Housing 18 is also provided with a vacuum exhaust line 40, connected to housing 18 by a suitable fitting 56, to exhaust fluids from housing 18.

Disposed within housing 18, for cooperation with fluid F sprayed through fluid spray heads 52, are a plurality of ultrasonic transducers 58. Ultrasonic transducers 58 generate ultrasonic waves which are transmitted through the fluid F supplied to the surface of ship's hull 12 through open face 50 by fluid spray heads 52. Ultrasonic transducers 58 are positioned at the appropriate distance from the surface to be cleaned, corresponding to the wave length of the frequency being used, and are powered with sufficient intensity such that cavitation is produced within the fluid medium at the surface to be cleaned. The term "cavitation" refers to the creation, growth, and collapse of gas bubbles in a fluid brought about by the alternating positive and negative pressures induced by ultrasonic waves. The intense instantaneous collapse of the bubble produces large pressures and temperatures at the center of the bubble, calculated to reach as high as 75,000 psi and 13,000 degrees F. While each collapse is of a very short duration, the number of collapses per second can well be in the millions, hence the cumulative effect can be significant. Focused ultrasonic pulses have been produced that have created intensities of 43,500 watts cm squared, which corresponds to a pressure of 725 atmospheres at the focal point. It is within the scope of the invention that the toxins present in the paint on the surface of the ship's hull may be nullified by the intense heat created during the bubble collapse. In this regard, it is noted that grit contaminated by organotin has been detoxified in a rotary kiln furnace operating at 1,000 degrees F. In the preferred embodiment, four ultrasonic transducers 58 are positioned so as to focus ultrasonic waves at three locations along three lines which are parallel with respect to the planes described by end walls 46. However, it will be appreciated that any appropriate number of ultrasonic transducers 58, arranged in any appropriate pattern, may be disposed within housing 18. Ultrasonic transducers 58 are powered by electrical lines (not shown) which extend through housing 18 to control and power supply car 22.

Disposed around the periphery of open face 50 and abutting the inside surfaces of side walls 44 and end walls 46 of housing 18, is a tubular, generally rectangularly-shaped air curtain member 60. A slit 62 is formed in the surface of tubular air curtain member 60 which faces open face 50, for blowing an air curtain around the periphery of the open face against the ship s hull, so as to contain fluid F within the housing 18. Air is supplied to tubular air curtain member 60 by means of air motors 64 disposed within housing 18. Air motors 64 are provided with external intake ducts 66, projecting through housing 18, to supply air to the air motors. Air motors 64 are supplied by electrical power through power line 36 (FIG. 1) which extends through housing 18 to control and power supply car 22. By means of tubular air curtain member 60, a controlled internal atmosphere is provided in housing 18 to contain the fluids and ensuing toxic waste within the housing so that they may be evacuated through vacuum exhaust line 40 (FIG. 1) into containers or holding tanks for consequent disposal.

Means are connected to the outside of housing 18 for retaining the housing on the ship's hull and moving the housing on the ship's hull, the means comprising an electromagnetic track system which includes electromagnetic tracks 20. Each of electromagnetic tracks 20 comprise an endless flexible belt which may be made, for example, by a rubber material, having an outside surface 68 and an inside surface 70. A plurality of electromagnets 72 are arranged along the entire length of the belt extending through the width of the belt so that each of the electro- magnets is exposed both at the inside and outside surfaces of the belt. A plurality of teeth 74 are formed on the inside surface 70 of the belt along the entire length of the belt. Details of the construction of electromagnetic tracks 20 and the means by which power is supplied to electromagnets 72 will be described hereinafter in conjunction with FIGS. 5–8.

Referring once again to FIGS. 2–3, a plurality of drive motors 76 are mounted on the outside of housing 18, at end walls 46, by means of brackets 78. Drive motor 76 may be any appropriate reversible motor such as linear stepping motors. Extending from each of drive motors 76 is a drive shaft 80, and a gear 82 is fixed to the projecting end of each of the shafts 80, so that a pair of gears extend a predetermined distance away from each of the side walls 44. Each of the gears 82 is provided with teeth which mate with the teeth 74 of electromagnetic tracks 70. Each of the two belts 20 is entrained around a pair of gears 82 so that each belt 20 may be driven by either or both of the drive motors 76 to which it is connected. Furthermore, each of the drive motors 76 may be independently driven to drive the two belts 20 at different speeds, thereby enabling housing 18 to be selectively rotated while in position on the ship's hull, so that for example, side walls 44 can be rotated from a vertical position on the ship's hull to a horizontal position on the ship's hull. When both tracks 20 are driven at the same rate of speed by their respective drive motors 76, housing 18 will be driven along a linear path, so that the cleaning operation may be performed in an orderly fashion. An electrical distribution junction box 84 is mounted on each of end walls 46 and power lines 86, 88 leading from junction box 84 supply electrical power to drive motors 76 and electromagnetic 72, respectively. Power is supplied to junction box 84 through power lines 34 (FIG. 1) leading from control and power supply car 22.

Referring now to FIGS. 5 through 8, details of the construction of electromagnetic tracks 20 and the means for supplying power to the electromagnetic tracks, will now be described in detail. As previously set forth, each of electromagnetic tracks 20 comprises an endless flexible belt having an outside surface 68 and an inside surface 70. A plurality of electromagnets 72 are arranged along the entire length of the belt extending through the width of the belt so that each of the electromagnets is exposed both at outside surface 72 and inside surface 70 of the belt along the entire length of the belt. Electromagnets 72 are arranged generally in two rows in the longitudinal direction of the belt. For convenience in manufacturing electromagnetic tracks 20, the tracks may be formed from an upper portion 90 and a lower portion 92. Holes 94 are formed at appropriate locations in lower portion 90, and mating holes are formed in upper portion 92. Holes 94 and 96 are provided with countersunk recesses at the face where lower portion 90 and upper portion 92 meet, to form recesses 98 for the receipt of an enlarged portion 100 of electromagnets 72. To assemble electromagnetic track 20, electromagnets 72 are placed in either of holes 94 or 96 and upper portion 90 is brought together with lower portion 92, so that enlarged portion 100 of electromagnets 72 is contained within recess 98. Upper portion 90 and lower portion 92 are then bonded together by any suitable means, such as, for example, by an adhesive.

A pair of electrical current contact strips 102 are disposed so that one of each of strips 102 is aligned in the longitudinal direction with one of each of the rows of electromagnets 72, contacting electromagnets 72 at the surface of the electromagnet which is exposed at inside surface 70 of electromagnetic track 20. Further, electrical current contact strips 102, as seen most clearly in FIG. 2, extend for a substantial portion of the length of the electromagnetic track entrained around a pair of ears 82, at the side of the entrained electromagnetic track 20 which faces ship's hull 12 when the cleaning device 10 is in position for cleaning operation. Electrical current contact strips 102 are provided with a flanged end 104 for retention in a slot 106 formed in each of a pair of contact housings 108. Electrical current contact strips 102 are biased into physical and electrical contact with electrodes 72 by means of a tension member 110, for example, a linear spring, positioned in each of slots 106 between each of contact housings 108 and each of flanged ends 104 of the pair of strips 102. Contact housings 108 are rigidly fixed with respect to housing 18 by supports 112 (FIGS. 2 and 3) which project from side walls 44 of housing 18. Electrical current is supplied to electrical current contact strips 102 through power lines 88 (FIG. 2) to actuate electromagnets 72 so that the electromagnets will magnetically grip the surface of the ship's hull 12 at the outside surface 68 of electromagnetic strips 20 when the cleaning device is positioned against the ship's hull for cleaning operation.

In operation, the cleaning device 10 of the present invention, which is resting either on platform 28 or at the bottom of dry-dock 16, is prepared for cleaning of ship's hull 12 by ensuring that the fluid supply tanks are full, that the fluid waste holding tanks are empty, that all controls contained with control and paper supply car 22 are in the off condition, and that tether 42 is properly fixed to its mooring support and to cleaning device 10. The controls in control and power supply car 22 are actuated so that power is supplied through lines 34 to junction box 84, and through power lines 88 to electrical current contact strips 102 to activate electromagnets 72. Cleaning device 10 is then maneuvered so as to be positioned on the ship's hull 12, with the electromagnets 72 activated by strips 102 engaging ship's hull 12 and magnetically retaining housing 18 on the ship's hull, with open face 50 of housing 18 facing the ship's hull. Next, the controls within control and supply car 22 are actuated to supply electrical power through power line 36 to actuate air motors 64. Air motors 64 blow a curtain of air through slit 62 of air curtain member 60, establishing an air curtain between open face 50 of housing 18 and ship's hull 12. Next, the controls within control and power supply car 22 are actuated to pump fluid from fluid supply tanks through fluid supply line 38, fluid spray heads 52 to spray fluid F through open face 50 of housing 18 to wet the surface of the ship's hull 12. At the same time, controls within control and power supply car 22 are actuated to create a vacuum in vacuum exhaust line 40 to exhaust fluids circulating within housing 18. Controls within control and power supply car 22 are then actuated to activate ultrasonic transducers 58 to impinge a flow of ultrasonic energy through open face 50 at the wetted surface of the ship's hull 12. At this point, cleaning operation of the surface of ship's hull 12 will begin, employing the cavitation effect previously described. Next, controls within control and power supply car 22 are actuated to supply power through lines 86 to drive motors 76. Initially, drive motors 76 are rotated at the same speed to drive ears 82 and both electromagnetic tracks 20 at the same speed, thereby driving cleaning device 10 in a linear horizontal row or vertical column, depending on the orientation of device 10 on ship's hull 12, as desired. As cleaning device 10 makes a linear horizontal or vertical pass, cleaning of ship's hull 12 continues under the effects of the ultrasonic cleaning action. While ultrasonic cleaning takes place, fluids and paint residuals are contained within enclosure 18 by the air curtain established through air curtain member 60, and are removed through vacuum line 40.

When cleaning device 10 has completed a vertical or horizontal pass, controls within control and power supply car 22 are actuated to slow or stop one of the pairs of drive motors 76 disposed near one of the side walls 44 to stop or slow one of the electromagnetic tracks 20, while the other pair of drive motors 76 are maintained at full operating speed. Cleaning device 10 thus rotates about the dead or slow track, changing the orientation of the device 10 with respect to the ship's hull 12. By appropriate manipulation of the speed of drive motors 76, cleaning device 10 may be directed along any desired path on ship's hull 12, the path being selected to provide the most efficient cleaning pattern. As the cleaning device 10 proceeds horizontally along the ship's hull, control and power supply car 22 may be moved along rails 26, so as to keep pace with the horizontal position of cleaning device 10.

Although in the illustrated preferred embodiment a rail-mounted control and power supply car 22 has been disclosed, it will be appreciated that the use of a stationary control and power supply means or other wheeled control and power supply cart is within the scope of the present invention.

When cleaning operations are completed, the controls within control and power supply car 22 are deactivated to turn off all operating systems, and cleaning device 10 is removed from the ship's hull.

In an additional embodiment, spray heads 52 are adapted to spray paint or other chemicals on the ship's hull, in which it is not necessary to provide cleaning device 10 with ultrasonic transducers 58. Also, in this embodiment, air curtain member 60 may optionally be removed.

Although only preferred embodiments are specifically illustrated and described herein, it will be appreciated that many other modifications and variations of the present invention are possible in light of the above teachings and within the purview of the appended claims without departing from the spirit and intended scope of the invention.

I claim:

1. A robotic ultrasonic device for cleaning ships' hulls while in dry dock comprising:

a housing having an open face adapted to confront a ship's hull;

means disposed in said housing for impinging a flow of fluid through said open face onto said ship's hull while in dry dock;

ultrasonic means disposed in said housing for impinging a flow of ultrasonic energy through said open face onto said fluid dlow impinging on said ship's hull while in dry dock;

means connected to the outside of said housing for retaining said housing on the ship's hull and moving said housing on the ship's hull.

2. The robotic ultrasonic cleaning device of claim 1 further comprising means disposed in said housing for containing the fluid impinged through said open face within the housing.

3. The robotic ultrasonic cleaning device of claim 2 wherein said means for containing the fluid comprises a tube disposed around the periphery of the open face of said housing, said tube having a slit formed therein for blowing an air curtain around the periphery of the open face against the ship's hull.

4. The robotic ultrasonic cleaning device of claim 3 wherein said means for containing the fluid further comprises a blower manifold connected with said tube and air motor connected with said manifold for generating said air curtain.

5. The robotic ultrasonic cleaning device of claim 1 wherein said means for impinging a flow of fluid comprises at least one fluid spray head.

6. The robotic ultrasonic cleaning device of claim 5 wherein said means for impinging a flow of fluid comprises a plurality of spray heads arranged in a plurality of rows, each of said rows defining a line which is disposed parallel to the plane of the open face of said housing.

7. The robotic ultrasonic cleaning device of claim 6 wherein each of the spray heads is provided with a fluid manifold connected to each of the spray heads in said row.

8. The robotic ultrasonic cleaning device of claim 7 wherein each fluid manifold is connected to a fluid supply which is located externally of said housing.

9. The robotic ultrasonic cleaning device of claim 1 wherein said ultrasonic means comprises at least one ultrasonic transducer.

10. The robotic ultrasonic cleaning device of claim 9 in which said ultrasonic means comprises a plurality of ultrasonic transducers each of which is arranged in a plane parallel to the plane of the open face of said housing.

11. The robotic ultrasonic cleaning device of claim 9 in which said housing has a pair of opposed side walls wherein the means for retaining the housing on the ship's hull and moving the housing on the ship's hull comprises:

an endless flexible belt having an inside surface and an outside surface, a plurality of electromagnets arranged along the entire length of the belt extending through the width of the belt so that each of said electromagnets is exposed at both the inside and outside surfaces of the belt, a plurality of teeth formed on the inside surface of the belt along the entire length of the belt;

an electrical current contact strip mounted on a side wall of said housing in contact with a portion of said electromagnets to supply electrical current to said electromagnets;

a pair of gears entraining said belt and contacting the teeth of said belt; and means mounted on said housing for rotating said gears to drive said belt around said gears.

12. The robotic ultrasonic cleaning device of claim 11 wherein a pair of gears is provided on both of the opposed side walls of the housing, a belt is entrained around each of said pairs of gears, an electrical current contact strip is mounted on each of said side wall in contact with a portion of the electromagnets of each of said belts, and means are provided on both of the side walls of said housing for rotating each of said pairs of gears to drive each of said belts around the respective pair of gears on which said belts are entrained.

13. The robotic ultrasonic cleaning device of claim 12 wherein each of said means for rotating each of said pairs of gears are operable independently of one another, whereby each of said belts are independently driveable around the respective pair of gears on which said belts are entrained.

14. The robotic ultrasonic cleaning device of claim 1 further comprising a vacuum line connected with said housing for exhausting the flow of fluid impinged on the ship's hull from said housing to a location remote from said housing.

15. A device for continuously spraying paint or other chemicals on a dry docked ship's hull while moving said device on said ship's hull comprising:

a housing having an open face adapted to confront the ship's hull;

spray means disposed in said housing for continuously spraying paint or other chemicals through said open face onto the ship's hull;

air curtain means disposed in said housing for containing within said housing the paint or other chemicals which have been sprayed; and means connected to the outside of said housing for retaining said housing on the ship's hull and moving said housing on the ship's hull while continuously spraying paint or other chemicals onto said ship's hull, whereby said sprayed paint or other chemicals are contained within said housing during said continuous spraying.

16. The device of claim 15 wherein the means for retaining the housing on the ship's hull and moving the housing on the ship's hull comprises:

an endless flexible belt having an inside surface and an outside surface, a plurality of electromagnets arranged along the entire length of the belt extending through the width of the belt so that each of said electromagnets is exposed at both the inside and outside surfaces of the belt, a plurality of teeth formed on the inside surface of the belt along the entire length of the belt;

an electrical current contact strip mounted on a side wall of said housing in contact with a portion of said electromagnets to supply electrical current to said electromagnets;

a pair of gears entraining said belt and contacting the teeth of said belt; and means mounted on said housing for rotating said gears to drive said belt around said gears.

17. The device of claim 16 wherein a pair of gears is provided on said sidewall of the housing and a pair of gears is provided on an opposed side wall of the housing, a belt is entrained around each of said pairs of gears, an electrical current contact strip is mounted on each of said side walls in contact with a portion of the electromagnets of each of said belts, and means are provided on both of the side walls of said housing for rotating each of said pairs of gears to drive each of said belts around the respective pair of gears on which said belts are entrained.

18. The device of claim 17 wherein each of said means for rotating each of said pairs of gears are operable independently of one another, whereby each of said belts are independently driveable around the respective pair of gears on which said belts are entrained.

* * * * *